US008185020B2

(12) United States Patent
Yoshie

(10) Patent No.: US 8,185,020 B2
(45) Date of Patent: May 22, 2012

(54) IMAGE FORMING APPARATUS AND METHOD FOR FORMING IMAGE WITH FINE PIGMENT AND THERMOPLASTIC FINE RESIN PARTICLES IN A CARRIER LIQUID

(75) Inventor: Naoki Yoshie, Ibaraki (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 513 days.

(21) Appl. No.: 12/220,386

(22) Filed: Jul. 24, 2008

(65) Prior Publication Data

US 2009/0035458 A1 Feb. 5, 2009

(30) Foreign Application Priority Data

Jul. 31, 2007 (JP) ..... 2007-198702
Aug. 29, 2007 (JP) ..... 2007-222218

(51) Int. Cl.
*G03G 15/10* (2006.01)
*G03G 15/16* (2006.01)
*G03G 9/00* (2006.01)
*G03G 13/10* (2006.01)

(52) U.S. Cl. ..... 399/249; 399/296; 430/108.1; 430/110.1; 430/110.4; 430/117.31

(58) Field of Classification Search ..... 399/390, 399/233
See application file for complete search history.

(56) References Cited

U.S. PATENT DOCUMENTS 3,256,197 A * 6/1966 Fauser et al. ..... 430/113
4,420,244 A * 12/1983 Landa ..... 399/249
5,521,046 A * 5/1996 Materazzi ..... 430/115
5,627,002 A * 5/1997 Pan et al. ..... 430/115
5,713,062 A * 1/1998 Goodman et al. ..... 399/49
5,839,037 A * 11/1998 Larson et al. ..... 399/249
5,923,929 A 7/1999 Avraham et al.
6,308,034 B1 10/2001 Nakashima et al.
6,397,030 B1 5/2002 Watanabe
6,466,756 B1 10/2002 Nakashima et al.
6,539,191 B2 3/2003 Itaya
6,740,152 B1 * 5/2004 Fukuda ..... 106/31.72
(Continued)

FOREIGN PATENT DOCUMENTS

JP 5-251863 A 9/1993
(Continued)

OTHER PUBLICATIONS

Japanese Office Action (with translation) related to Japanese Patent Application No. 2007-198702 mailed Dec. 20, 2011.
(Continued)

*Primary Examiner* — David Gray
*Assistant Examiner* — David Bolduc
(74) *Attorney, Agent, or Firm* — Brinks, Hofer, Gilson & Lione

(57) ABSTRACT

An image forming apparatus employing nonvolatile liquid developers is provided, which image forming apparatus exhibits high transfer efficiency in transferring images on an image carrier to a recording media and enables formation of images with sufficient fixing strength. An image forming apparatus which incorporates a squeezing mechanism which removes a part of carrier liquid from the liquid developer incorporating image visualizing particles, fine thermoplastic resin particles, and nonvolatile carrier liquid, and incorporates a transferring mechanism which transfers a visible image, in which a part of carrier liquid is removed, onto the recording medium.

21 Claims, 6 Drawing Sheets

U.S. PATENT DOCUMENTS

| | | | | |
|---|---|---|---|---|
| 6,996,361 | B2 * | 2/2006 | Ichida et al. | 399/302 |
| 7,433,636 | B2 * | 10/2008 | Teschendorf et al. | 399/296 |
| 2002/0085860 | A1 | 7/2002 | Itaya | |
| 2005/0141927 | A1 * | 6/2005 | Chou et al. | 399/296 |
| 2005/0141928 | A1 * | 6/2005 | Teschendorf et al. | 399/296 |

FOREIGN PATENT DOCUMENTS

| | | | |
|---|---|---|---|
| JP | 5-281863 | A | 10/1993 |
| JP | 6-138718 | A | 5/1994 |
| JP | 2000-56575 | A | 2/2000 |
| JP | 2001-22186 | A | 1/2001 |
| JP | 2001-92199 | A | 4/2001 |
| JP | 2002-202645 | A | 7/2002 |
| JP | 2003-175612 | A | 6/2003 |

OTHER PUBLICATIONS

Japanese Office Action (with translation) related to Japanese Patent Application No. 2007-222218 mailed Dec. 20, 2011.

* cited by examiner

IMAGE FORMING APPARATUS AND METHOD FOR FORMING IMAGE WITH FINE PIGMENT AND THERMOPLASTIC FINE RESIN PARTICLES IN A CARRIER LIQUID

This application is based on Japanese Patent Applications No. 2007-198702 filed on Jul. 31, 2007, and No. 2007-222218 filed on Aug. 29, 2007, in Japanese Patent Office, the entire content of which is hereby incorporated by reference.

TECHNICAL FIELD

The present invention relates to an image forming apparatus and a method for forming an image both employing a liquid developer.

Electrophotographic image forming apparatuses, in which electrostatic latent images are formed on a photoreceptor and toner is adhered to the above latent image, followed by transfer onto paper and fixing, are employed in copiers, MFPs (multifunction peripherals), facsimile machines, and printers. In such image forming apparatuses, a dry developing system using toner powder is generally used widely.

However, the dry toner powder has problems of scattering and low resolution due to a relatively large diameter of from 7 to 10 μm.

Consequently, in image forming apparatuses, such as an on-demand printing apparatus, which is required to realize higher image quality and higher resolution, has been employed a wet developing system which employs a liquid developer which includes a carrier liquid and toner particles dispersed therein. In the wet developing system, since toner particles can be smaller than the dry toner powder, and amount of electrostatic charge of toner particles can be larger, a blur of a toner image hardly occurs, and high resolution can be realized.

As a liquid developer known is one which includes a nonvolatile carrier liquid such as silicone oil and toner particles, containing resins and pigments, dispersed in the carrier liquid at a high concentration (for example, refer to U.S. Pat. No. 6,996,361). By employing a nonvolatile carrier liquid, problems of influence on human bodies and the environment are decreased. Further, a high concentration of toner provides an advantage of fewer consumption of the liquid developer.

When electrostatic latent images are developed by employing the above liquid developer, a thin layer of the developer is formed on a developer carrier, such as a developing roller, and the development is carried out in such a way that the thin layer is brought into contact with a photoreceptor.

A toner image formed on the photoreceptor via the development is directly transferred onto a recording medium, or is primarily transferred onto an intermediate transfer body followed by secondary transfer onto the recording medium. The toner image transferred onto the recording medium is heated via a fixing device and fixed on the recording medium.

However, in the case where a liquid developer is employed, the carrier liquid is also transferred onto the recording medium together with the toner image. Since the transferred carrier liquid exists between the recording medium and the toner, there has been a problem in which sufficient fixing strength can not be realized.

Consequently, an object of the present invention is to provide an image forming apparatus and a method which enable formation of an image with sufficient fixing strength on a recording medium in the field of an apparatus and a method, for forming an image, which employ a nonvolatile liquid developer.

Further, another object of the present invention is to provide, in the field of an apparatus and a method for forming an image which employ a nonvolatile liquid developer, an apparatus and a method for forming an image in which there is realized a high transfer efficiency in the process of transferring an image formed on an image carrier such as a photoreceptor or an intermediate transfer body onto a recording medium.

SUMMARY

The present invention is characterized as described below to solve the aforesaid problems.

In view of forgoing, one embodiment according to one aspect of the present invention is an image forming apparatus, comprising:

a developing device which is adapted to contain a liquid developer including a nonvolatile carrier liquid, fine pigment particles dispersed in the carrier liquid and thermoplastic fine resin particles dispersed in the carrier liquid, and to develop an electrostatic latent image into a visible image with the liquid developer, the pigment particles and the fine resin particles being charged to a same charging polarity;

a squeezing mechanism which is adapted to remove a part of the carrier liquid included in the visible image formed by the developing device; and a transferring mechanism which is adapted to transfer the visible image, from which the part of the carrier liquid has been removed by the squeezing mechanism, onto a recording medium.

According to another aspect of the present invention, another embodiment is a method for forming an image, comprising the steps of:

developing an electrostatic latent image into a visible image with a liquid developer which includes a nonvolatile carrier liquid, fine pigment particles dispersed in the carrier liquid and thermoplastic fine resin particles dispersed in the carrier liquid, the pigment particles and the fine resin particles being charged to a same charging polarity;

removing a part of the carrier liquid included in the visible image; and transferring the visible image, from which the part of the carrier liquid has been removed, onto a recording medium.

According to another aspect of the present invention, another embodiment is an image forming apparatus, comprising:

a developing device which is adapted to contain a liquid developer including a nonvolatile carrier liquid, toning particles dispersed in the carrier liquid, and to develop an electric latent image into a visible image with the liquid developer;

a resin particle supplying mechanism which is adapted to contain an auxiliary liquid including fine resin particles with a diameter smaller than a diameter of the toning particles and to apply the auxiliary liquid to the visible image to make the fine resin particles exist therein, the fine resin particles not visually affecting the visible image;

a squeezing mechanism which is adapted to remove a part of the carrier liquid included in the visible image; and a transferring mechanism which is adapted to transfer the visible image, from which the part of the carrier liquid has been removed by the squeezing mechanism, onto a recording medium.

According to another aspect of the present invention, another embodiment is a method for forming an image, comprising the steps of:

developing an electrostatic latent image into a visible image with a liquid developer which includes a nonvolatile carrier liquid and toning particles dispersed in the carrier liquid;

applying an auxiliary liquid, which includes fine resin particles with a diameter smaller than a diameter of the toning particles, to the visible image to make the fine resin particles exist therein, the fine resin particles not visually affecting the visible image;

removing a part of the carrier liquid included in the visible image; and transferring the visible image, from which the part of the carrier liquid has been removed, onto a recording medium.

DETAILED DESCRIPTION OF THE PREFERRED EMBODIMENT

The preferred embodiments according to the present invention will now be described with reference to the drawings.

Figure 1:
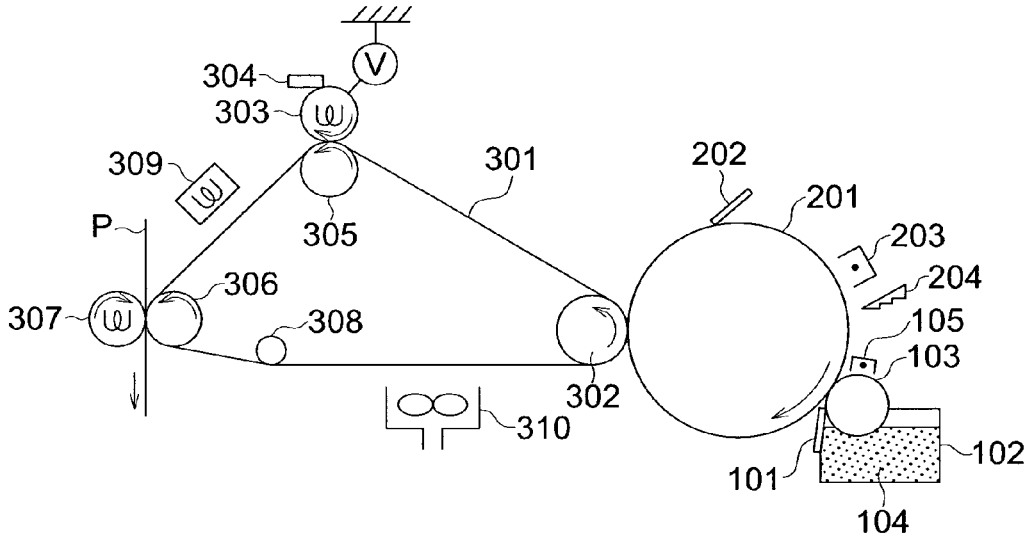
FIG. 1 is a diagram showing the overall constitution of an image forming apparatus in a first embodiment of the present invention.

Overall Constitution of Image Forming Apparatus According to First Embodiment and its Operation FIG. 1 is a schematic constitutional diagram showing an image forming apparatus of a first embodiment according to the present invention. Around a drum-shaped photoreceptor 201, there are arranged in the rotational direction, in the following order, a charging device 203, an exposure device 204, a developing roller 103, an intermediate transfer body 301, and a photoreceptor cleaning blade 202. Intermediate transfer body 301 is arranged under tension by a primary transfer rollers 302, backup rollers 305 and 306, and tension roller 308. Around intermediate transfer body 301, there are arranged in the moving direction, in the following order, a squeezing mechanism such as a squeezing roller 303, a heating mechanism such as a halogen heater 309 and a transferring mechanism such as a secondary transferring roller 307, and a cooling member 310. Numeral 304 represents a cleaning blade to clean squeezing roller 303.

The surface of photoreceptor 201 is uniformly charged to a predetermined surface potential with charging device 203 and then exposed by exposure device 204 based on image data, whereby an electrostatic latent image is formed on the surface of photoreceptor 201. Subsequently, the electrostatic latent image on photoreceptor 201 is developed to be visualized by developing roller 103 carrying liquid developer 104 from developer tank 102, whereby a visible image (hereinafter also referred to as a toner image) is formed. The liquid developer on developing roller 103 is charged by a corotron charging device 105. Further, the liquid developer which remains on developing roller 103 after development is scraped off with a cleaning blade 101.

In this first embodiment, the liquid developer contains fine pigment particles as toner, fine thermoplastic resin particles, and a carrier liquid which is a nonvolatile liquid. The fine pigment particles and the fine resin particles are charged to the same polarity with corotron charging device 105.

Further, a toner image developed on photoreceptor 201 contains not only toner but also a large amount of carrier liquid.

The toner image on photoreceptor 201 is transferred onto intermediate transfer body 301, which is one of image carriers, by application of a predetermined voltage to primary transfer rollers 302. The voltage applied to the toner is opposite to the polarity of primary transfer rollers 302, and the potential difference between itself and photoreceptor 201 is from 300 V to 3 kV.

Figure 2:
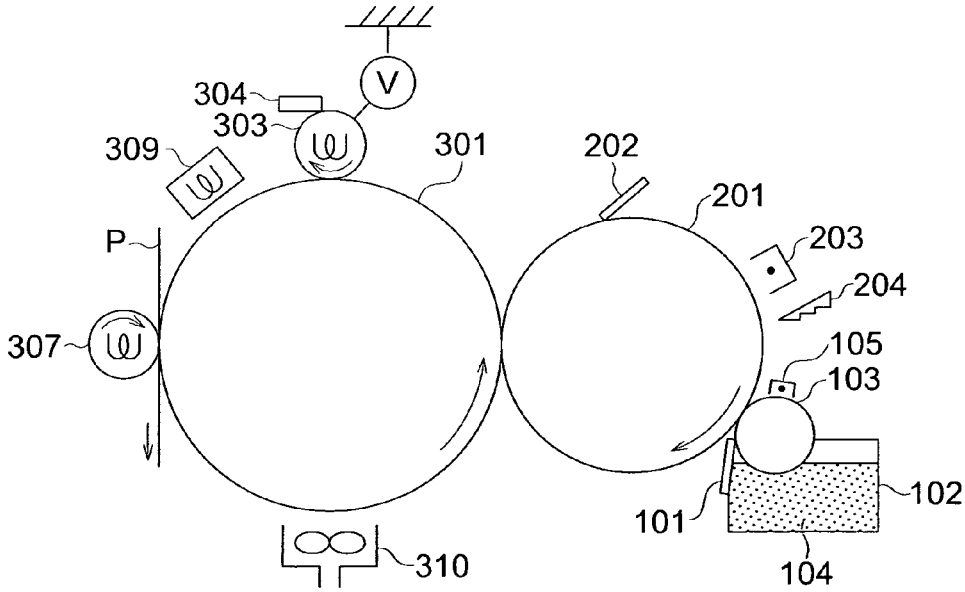
FIG. 2 is a diagram showing another overall constitution of an image forming apparatus in the first embodiment.

Intermediate transfer body 301 may be either belt-shaped as shown in FIG. 1, or a drum-shaped as shown in FIG. 2. When belt-shaped intermediate transfer body 301 is employed, freedom of arrangement of the elements is enhanced, whereby it is possible to downsize the entire apparatus. On the other hand, when drum-shaped intermediate transfer body 301 is employed, positional accuracy is more easily achieved, whereby it is possible to constitute a simpler driving system.

When intermediate transfer body 301 is belt-shaped, the materials forming the belt are resins and elastic materials. When transferability onto rough paper is considered, elastic bodies are preferred, and those which are also heat resistant are more preferred. Their thickness is preferably from 50 μm to 1 mm, their volume resistance is preferably from $10^6$ to $10^{12}$ Ωcm, and their surface resistance is preferably from $10^6$ to $10^{12}$Ω/□. Usable resins include, but are not limited to, polyester, polypropylene, polyamide, polyimide, fluorine based resins, and polyphenyl sulfate. Usable elastic materials include, but are not limited to, silicone rubber, fluorocarbon rubber, EPDM, urethane rubber, and nitrile rubber. When stability of transportation of toner images is considered, a multi-layered belt containing a resin substrate having thereon an elastic layer is preferred. In such a case, the thickness of the resin substrate is preferably from 50 to 200 μm, while the thickness of the elastic layer is preferably from 200 μm to 1 mm. Further, it is desirable that the uppermost layer exhibits high releasability. To realize that, it is more preferable to provide, as a surface layer, a hard layer having a width of at most 1 μm which contains fluorine or silicon based polymers of a low surface energy or has been subjected to a plasma treatment.

With regard to the liquid developer transferred onto intermediate transfer body 301, some of the carrier liquid in the above layer is removed with squeezing roller 303 which serves as a member to remove a part of the carrier liquid. Squeezing roller 303 is a sliding member to which voltage of the same polarity as the charging polarity of the fine pigment particles and comes into contact with the visible image (the liquid developer layer) on intermediate transfer body 301. By applying a voltage of the same polarity as fine pigment particles to squeezing roller 303, it is possible to minimize migration of the fine pigment particles onto squeezing roller 303. On the other hand, a part of the carrier liquid is transferred onto squeezing roller 303, and the amount of carrier liquid on intermediate transfer body 301 decreases after passing squeezing roller 303. The carrier liquid moved to the squeezing roller 303 side is cleaned with cleaning blade 304.

The amount of carrier liquid of the liquid developer on intermediate transfer body 301 is decreased with squeezing roller 303 prior to transfer onto a recording medium P. By decreasing the amount of carrier liquid, toner particles (fine pigment particles) come into contact with each other and are further closely contacted to be aggregated. By referring to FIGS. 3*a* and 3*b*, appearance during the above-described process will be described while comparing the case (FIG. 3*a*), in which a common liquid developer is employed, to the case (FIG. 3*b*), in which the liquid developer of the present embodiment is employed.

Figure 3A:
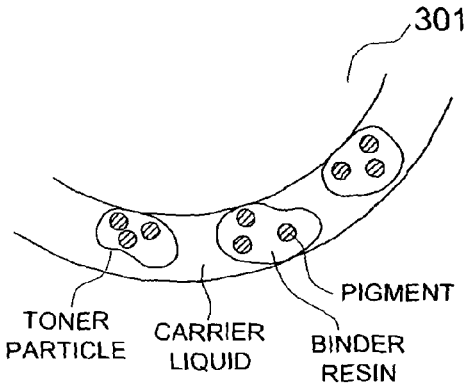
FIGS. 3*a* and 3*b* are schematic diagrams showing a toner image on an image carrier from which the carrier liquid has been partially removed.
Figure 3B:
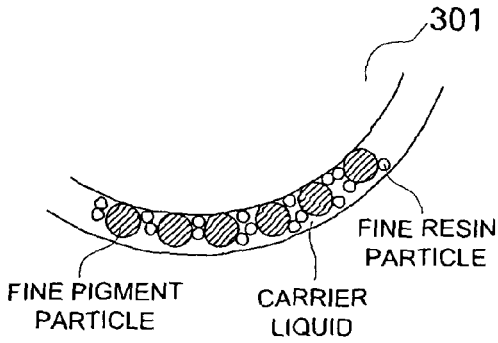

Common toner particles are prepared by dispersing pigments into binder resin and their particle diameter is relatively large. When carrier has been removed with squeezing roller 303, as shown in FIG. 3*a*, a relatively large amount of carrier liquid still remains among particles. Compared to this, in the liquid developer of the present embodiment, as shown in FIG. 3*b*, the pigment fine particles, used alone as toner, are densely attached to the imager carrier, and there are the pigment fine particles having the resin fine particles therebetween since thermoplastic resin fine particles are dispersed. As a result, the amount of carrier liquid among the particles is decreased, whereby it is possible to increase the solid ratio of toner images. Further, fine pigment particles and fine resin particles come into close contact with each other to generate mutual adhesion force, whereby they aggregate.

In such a state, the image on intermediate transfer body 301 is heated with halogen heater 309 which serves as a heating mechanism. Fine resin particles are put into a softened or molten state by heating and are forwarded to the following transfer process.

In the transfer process onto the recording media, a toner image is transferred in the thermally molten state onto the recording medium P by secondary transferring roller 307, which is a heating roller including a heater and backup roller 306. At that time, the transfer efficiency is nearly 100%, and thus, fixing capability after the transfer is enhanced, and it is possible to form images having a high fixing strength.

Squeezing roller 303 preferably includes a heater in the interior and heats the liquid developer on intermediate transfer body 301. Further, backup roller 305 may incorporate a heater.

Squeezing roller 303 is made of an elastic material, for example, at an Asker A hardness of from 20 to 90 degree. Usable elastic materials include, but are not limited to, silicone rubber, fluororubber, EPDM, urethane rubber, and nitrile rubber. In the case where squeezing roller 303 is heated, it may be heated to from about 80 to about 200° C. Further, prior to the transfer onto the recording medium P, a plurality of such squeezing rollers 303 may be arranged. It is possible to omit a heating member, such as a halogen heater 309, which heats intermediate transfer body 301 prior to the transfer onto the recording medium P.

As described above, by heating the toner image on intermediate transfer body 301 before transferring it onto recording member P, the toner image is made to be a film, whereby the transfer efficiency can be closer to 100%.

In the above description, thermal transfer is employed in the secondary transfer, but electric field transfer or shearing transfer may also be employed. When thermal transfer is employed, secondary transferring roller 307 and backup roller 306 incorporate a heater. In this case, heating temperature is preferably from 80 to 200° C. Backup roller 306 is preferably an elastic material at an Asker A hardness of from 20 to 90° C., and usable elastic materials include, but are not limited to, silicone rubber, fluororubber, EPDM. urethane rubber, and nitrile rubber.

After transferring onto recording medium P, intermediate transfer body 301 is cooled with cooling member 310. It is possible to employ, as cooling member 310, a cooling fan. By cooling intermediate transfer body 301 with cooling member 310, heat transferred to photoreceptor 201 is minimized, whereby it is possible to enhance the durability of photoreceptor 201. It should be noted that above cooling member 310 may be omitted.

In the embodiment as described above, a case is described, in which intermediate transfer body 301 is employed. However, an alternative constitution may be employed in which the image on photoreceptor 201 is transferred directly onto recording medium P without using intermediate transfer body 301. Photoreceptor 201 is a kind of an image carrier. In this case, squeeze roller 303 is preferably arranged around photoreceptor 201 to remove a part of the carrier liquid from a visible image on the photoreceptor 201.

(Composition of Liquid Developer)

In the first embodiment, the liquid developer contains at least a carrier liquid, fine pigment particles, a dispersing agent, and fine resin particles.

As a carrier liquid, selected is liquid which is nonvolatile, has a vapor pressure of less than 200 Pa at 20° C., has a low dielectric constant of at most 3, and has a high electrical insulation property. Examples of appropriate carrier liquids include hydrocarbon based ones (such as liquid paraffin), silicone oil, animal and plant oil, and mineral oil.

Usable fine pigments particles include furnace black, lamp black, acetylene black, channel black, C.I. pigment black, orthoaniline black, toluidine orange, permanent carmine FB, fast yellow AAA, disazo orange PMP, lake red C, brilliant carmine 6B, phthalocyanine blue, quinacridone red, C.I. pigment blue, C.I. pigment red, C.I. pigment yellow, dioxane violet, pictoria pure blue, alkali blue toner, alkali blue R toner, fast yellow 10G, orthonitroaniline orange, toluidine red, barium red 2B, calcium red 2B, pigment scarlet 3B lake, ansocine 3B lake, rhodamine 6B lake, methyl violet red, basic blue 6B lake, fast sky blue, reflex blue G, brilliant green lake, copper phthalocyanine, phthalocyanine green G, Prussian blue, Ultramarine blue, iron oxide powder, Chinese white, calcium carbonate, clay, barium sulfate, alumina white, aluminum powder, daylight fluorescent pigments, and pearl pigments.

Further, in order to enhance the dispersibility of fine pigment particles, pigment derivatives may be employed. It is possible to employ pigment derivatives having desired functional groups such as a carboxyl group, a sulfonic acid group, a hydroxyl group, an amino group, or an amido group.

Fine pigment particles are dispersed into a carrier liquid. The volume average diameter of the secondary particles is preferably at most 500 nm, but is more preferably from 50 to 300 nm. By realizing the above particle diameter, it is possible to decrease gaps among fine pigment particles. When it is less than 30 nm, developability to photoreceptor 201 tends to deteriorate, while when it exceeds 500 nm, effects of removal of the carrier liquid tend to decrease.

The combination ratio of fine pigment particles is preferably from 3 to 30% by mass with respect to the mass of the carrier liquid. When it is less than 3% by mass, the possibility exists in which the desired concentration may not be realized, and dispersibility tends to deteriorate when it is more than 30% by mass.

It is possible to employ, as a dispersing agent of fine pigment particles, hydroxyl group-containing carboxylic acid esters, long chain polyamide and high molecular weight acid ester salts, high molecular weight polycarboxylic acid salts, long chain polyamide and polar acid ester salts, high molecular weight unsaturated acid esters, high molecule copolymers, modified polyurethane, modified polyacrylate, polyether ester type anionic surface active agents, naphthalenesulfonic acid formalin condensation product salts, aromatic sulfonic acid formalin condensation product salts, polyoxyethylene alkylphosphoric acid esters, polyoxyethylene nonylphenyl ether, polyester polyamine, and stearylamine acetate.

The combination ratio of dispersing agents for fine pigment particles is preferably from 10 to 200% by mass with respect to the mass of the total fine pigment particles.

The necessary amount of dispersing agents varies depending on the diameter of the fine pigment particles. If fine pigment particles of smaller diameter are to be used, it is preferable to use a larger amount. When the combination ratio is less than 10% by mass, dispersibility may be deteriorated, and electric conductivity of the liquid is so high as to lower the chargeability when it is more than 200% by mass.

It is preferable to employ, as a dispersing agent for fine pigment particles, polymer based pigment dispersing agents. Polymer based pigment dispersing agents incorporate a long chain alkyl group to enhance compatibility with organic solvents and an acidic or basic functional group for adsorption onto pigments. Preferable dispersing agents vary depending on pigments. It is preferable to select pigment dispersing agents exhibiting acidity or basicity which is opposite to that of the pigments.

It is preferable that fine resin particles have thermoplasticity and a glass transition temperature of from −10° C. to 60° C.

Fine resin particles are dispersed into a carrier liquid, and the secondary diameter of the particles is preferably from 10 to 500 nm in terms of volume average particle diameter, but is more preferably from 50 to 300 nm. By regulating the particle diameter within the above range, the particles are more easily filled among fine pigment particles, whereby it is possible to effectively remove the carrier liquid. It is difficult to produce particles of a diameter of less than 10 nm. Further, mobility of such fine particles by an electric field may be limited, whereby developability to photoreceptor 201 tends to deteriorate. Further, when the particle diameter exceeds 500 nm, fine particles tend to result in aggregation, and effects of removing the carrier liquid tend to decrease.

Commercial fine resin particles are available as the fine resin particles. Further, non-aqueous dispersion (NAD), which is prepared by dispersing fine resin particles into poor solvents, may be used to be blended with a carrier liquid.

NAD contains a resin dispersion phase which is insoluble in solvent and polymer dispersion stabilizers. As one example of the resin dispersion phase may be a radically polymerized acryl based polymer. The polymer dispersion stabilizers of NAD are polymers of an average molecular weight of greater than or equal to 1,000. Polymer dispersing agents incorporate a combination active site with the resin dispersion phase and have functional groups which are necessary for cross-linkage and adhesion. As polymer dispersing agents of NAD, preferred are those which are prepared by introducing functional groups, such as a hydroxyl group, a carboxyl group, a glycidyl group, an amino group, or an amido group, into acrylic resins, polyester resins, alkyd resins, melamine resins, or cellulose derivatives. The glass transition temperature of the resin dispersion phase is desirably from −10° C. to 60° C. When it is lower than −10° C., storage stability deteriorates, while fixability may be deteriorated when it is higher than 60° C. A dispersion phase such as an NAD dispersion phase, which has small diameter and many polar groups, exhibits higher stability in a liquid state, enables a decrease in Tg, and is easily fixed at low temperature, compared to conventional liquid developers. Further, the NAD dispersion phase may incorporate reactive functional group so that particles react, if desired, with each other or the interior of particles undergoes reaction.

The combination ratio of fine resin particles (being a solid portion) is preferably from 0.5 to 20 times with respect to fine pigment particles. When it is less than 0.5 times, fixability deteriorates, while developability may be degraded due to an increase in the viscosity when it excesses 20 times.

A liquid developer may be manufactured in such a manner that a dispersion liquid which is prepared by dispersing fine pigment particles into solvents, and a dispersion liquid which is prepared by dispersing fine resin particles into solvents, are separately prepared and they are blended. Alternatively, dispersion liquid may be prepared by polymerizing fine resin particles in the presence of fine pigment particles.

(Entire Constitution and Operation of Image Forming Apparatus According to Second Embodiment)

Figure 4:
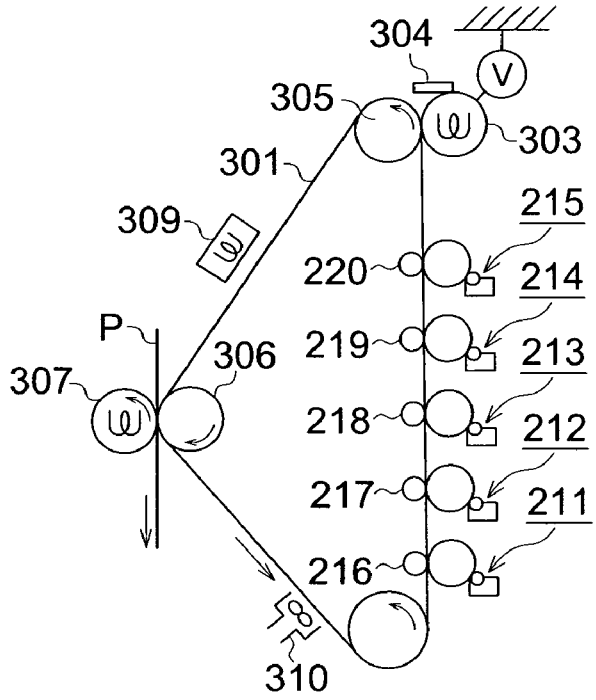
FIG. 4 is a diagram showing the overall constitution of an image forming apparatus in a second embodiment of the present invention.

FIG. 4 is a schematic constitutional diagram showing an image forming apparatus of the second embodiment according to the present invention. Around belt-shaped intermediate transfer body 301 which is one of image carrier, arranged are image forming units 211 through 214 which are employed to visualize an electrostatic image on the image carrier with liquid developers incorporating toning particles of each of Y, M, C, and K colors, primary transferring rollers 216 through 219, each of which transfers the visualized image formed by each of the image forming units to intermediate transfer unit 301, a resin particle supplying mechanism such as a fine resin particle attaching device 215 which attaches electrostatic fine resin particles to the visualized image transferred onto intermediate transfer body 301 from above the visualized image using an auxiliary liquid incorporating the electrostatic fine resin particles, a primary transferring roller 220 which is employed for electrostatically transferring the aforesaid electrostatic fine rein particles onto intermediate transfer body 301, squeezing roller to remove a port of the carrier liquid of the liquid developer layer on intermediate transfer body 301, and a secondary transfer roller 307 incorporating a heater therein.

Figure 5:
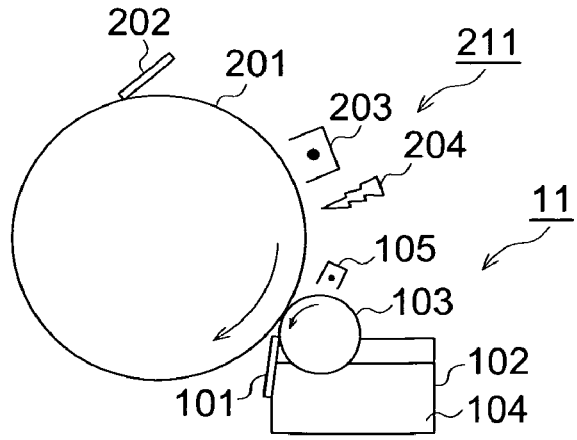
FIG. 5 is a schematic diagram showing the image forming unit of the image forming apparatus in FIG. 4.

In FIG. 5, shown is a diagram showing the schematic constitution of image forming unit 211 as a detailed view of image forming units 211 through 214 shown in FIG. 4.

Image forming unit 211 incorporates a photoreceptor 201 as an image carrier, and around it there are incorporated a charging device 203, an exposure device 204, a developing device 11 incorporating a liquid developer having yellow toning particles, and a photoreceptor cleaning blade device 202. First developing device 11 incorporates a developer tank 102 which stores a liquid developer containing a nonvolatile carrier liquid and yellow image visualizing particles (toning particles) dispersed therein, a developing roller 103 which draws up liquid developer 104 from aforesaid developer tank 102 and develops electrostatic images on photoreceptor 201, a cleaning blade 101 which cleans liquid developer 104 on developing roller 103 after development, and a corotron charging device 105.

Other image forming units 212, 213, and 214 are constituted in the same way as image forming unit 211, except that the color of each of the image visualizing particles (toning particles) is magenta, cyan, and black.

Further, fine resin particle attaching device 215 is constituted in the same manner as image forming unit 211, except that, instead of liquid developer 104 in image forming unit 211 shown in FIG. 5, employed is, as an auxiliary liquid, a carrier liquid incorporating electrostatic fine resin particles having a smaller average particle diameter than the average particle diameter of the image visualizing particle of each color.

Image forming operation will now be described.

In image forming units 211 through 214 of each color, the surface of photoreceptor 201 is uniformly charged to a predetermined surface potential with charging device 203, and then exposed with image data of its color with exposure device 204, whereby an electrostatic latent image is formed on the surface of photoreceptor 201. Subsequently, the electrostatic latent image on photoreceptor 201 is visualized by development with developing roller 103 carrying liquid developer 104 from developer tank 102, and a visualized image of its color is formed on the surface on photoreceptor 201. At that time, liquid developer 104 on developing roller 103 has been charged to a predetermined charge amount with corotron charging device 105. Further, after development, the liquid developer remaining on developing roller 103 is scraped off with cleaning blade 101.

Liquid developer 104 incorporates, as the image visualizing particles (hereinafter also referred to as toners), a mixture of resins and pigments of each color, and a carrier liquid which is a nonvolatile liquid with a vapor pressure of less than or equal to 200 Pa at 20° C. Other than the mixture of resins and pigments, the image visualizing particles may be particles containing pigments which are the same as in the first embodiment.

As noted above, the toner image formed on photoreceptor 201 incorporates not only the toner but also a relatively large amount of the carrier liquid.

The toner image of each color on photoreceptor 201 is transferred onto intermediate transfer body 301, which is one of image carriers, by application of a predetermined voltage to primary transferring rollers 216 through 219. Voltage of polarity opposite to that of the toner is applied onto primary transferring rollers 216 through 219, and potential difference between the primary transferring roller and photoreceptor 201 is from 300 V to 3 kV.

The toner image of each color is transferred onto intermediate transfer body 301 by image forming units 211 through 214 to achieve superposition, whereby a color image is formed on intermediate transfer body 301.

Subsequently, electrostatic fine resin particles with an average particle diameter which is smaller than that of the image visualizing particles of each color are electrostatically attached onto the color image formed on intermediate transfer body 301, employing an auxiliary liquid incorporating electrostatic fine resin particles. The electrostatic fine resin particles are charged to the same polarity as the charged polarity of the image visualizing particles. Further, a liquid incorporating electrostatic fine resin particles is a liquid which is prepared by dispersing the electrostatic fine resin particles into the same carrier liquid of liquid developer 104.

In fine resin particle attaching device 215, the surface of photoreceptor 201 is uniformly charged to a predetermined surface electric potential with charging device 203, and then image data are exposed by exposure device 204, and an electrostatic latent image is formed on the surface of photoreceptor 201. Subsequently, the electrostatic latent image on photoreceptor 201 is developed with developing roller 103 carrying the auxiliary liquid incorporating the electrostatic fine resin particles from developer tank 102 with the electrostatic fine resin particles attached thereto, whereby a fine electrostatic resin particle image corresponding to the image data is formed on the surface of photoreceptor 201. Electrostatic fine resin particles have been charged to a predetermined charge amount with corotron charging device 105. Further, after development, the residual liquid on developing roller 103 is scraped off with cleaning blade 101.

An electrostatic fine resin particle image formed on photoreceptor 201 is electrostatically transferred onto intermediate transfer body 301 with primary transferring rollers 220.

It is preferable that the electrostatic fine resin particle image is selectively attached to the region where a color image is formed with image visualizing particles. For this purpose, image information to form an electrostatic fine resin particle image is made to be the same as the color image data (data made by integrating those color data in the case of YMCK image data), and the fine resin particle image is transferred to be in the same position of the color image on intermediate transfer body 301.

On the other hand, any big problem could not occur, even if electrostatic fine resin particles were attached to the exterior of the region where the color image is formed. For example, it is possible to transfer electrostatic fine resin particles to the entire range in the width direction of intermediate transfer body 301. In such a case, in the fine resin particle attaching device, developing roller 103 in the image forming unit in FIG. 5 can be configured to directly face intermediate transfer body 301 so that electrostatic fine resin particles move onto intermediate transfer body 301 by electric potential difference between developing roller 103 and primary transferring roller 220.

Figure 6A:
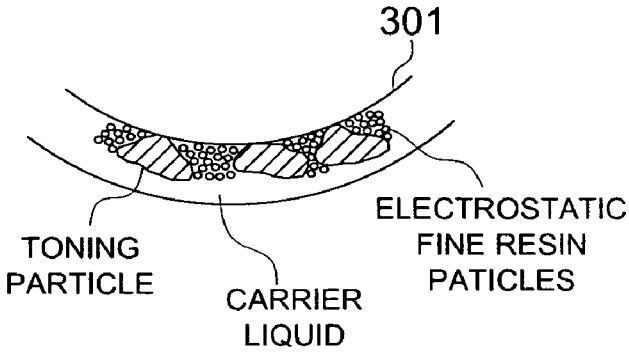
FIG. 6*a* is a schematic diagram showing a visualized image in the second embodiment.
Figure 6B:
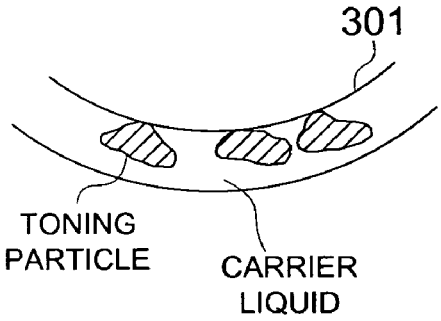
FIG. 6*b* is a schematic diagram showing a visualized image when no electrostatic fine resin particles are employed.

FIG. 6*a* shows a state in which electrostatic fine resin particles have been transferred to a visualized image from above. Further, as a comparative example, FIG. 6*b* shows a state in which only a visualized image is present. In FIG. 6*b* as a comparative example, a large amount of a carrier liquid is present among the image visualizing particles, while in the state (FIG. 6*a*) in which electrostatic fine resin particles are transferred to the visualized image from above, electrostatic fine resin particles exist among the image visualizing particles, whereby the ratio of the carrier liquid is reduced.

The diameter of the image visualizing particles is not particularly limited, but the volume average particle diameter is from 0.05 to 10 μm. The average particle diameter is set to be smaller than that of the image visualizing particles so that the electrostatic fine resin particles can easily enter among the image visualizing particles. The volume average diameter of the electrostatic fine resin particles is preferably from 10 to 500 nm and more preferably from 50 to 500 nm. When the diameter of the electrostatic fine resin particles is less than 10 nm, it may be difficult to transfer the particles onto intermediate transfer body 301, and when it exceeds 500 nm, the effects to reduce the carrier liquid may be reduced.

Figure 7:
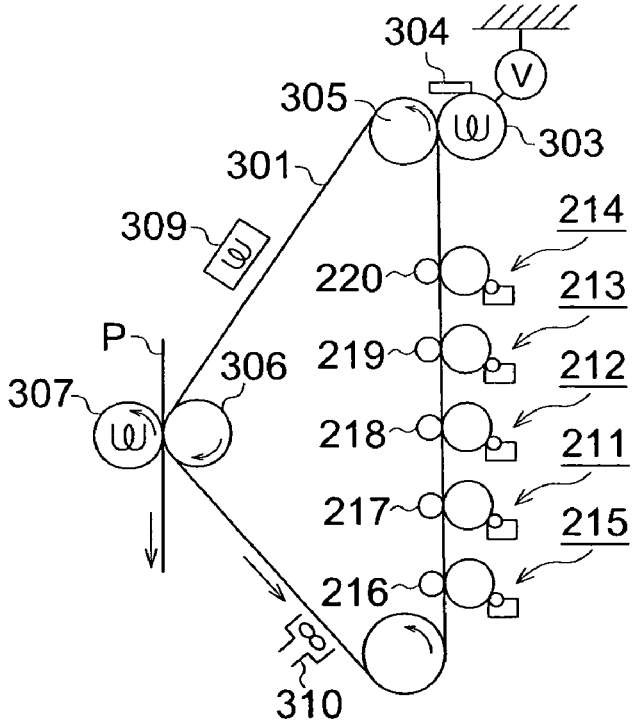
FIG. 7 is a diagram showing another overall constitution of an image forming apparatus in the second embodiment.
Figure 8:
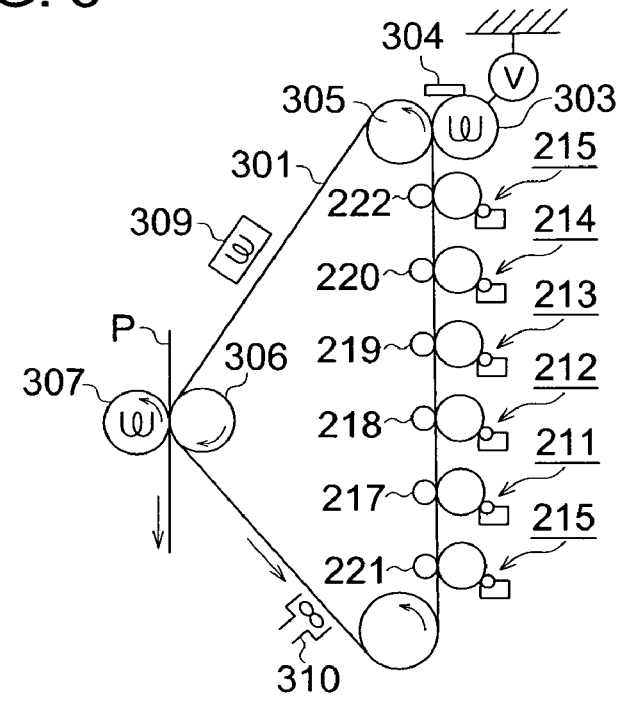
FIG. 8 is a diagram showing another overall constitution of an image forming apparatus in the second embodiment.

Further, as shown in FIG. 7, a fine resin particle attaching device 215 can be arranged in the upstream of image forming units 211 through 214 so that it attaches the electrostatic fine resin particles to an intermediate transfer body 301 before image forming units 211 through 214 carry out image formation. Further, as shown in FIG. 8, a fine resin particle attaching device 215 is arranged in both the upstream and the downstream of image forming units 211 through 214 so that they attach the electrostatic fine resin particles to an intermediate transfer body 301 before and after image forming units 211 through 214 form an image on intermediate transfer body 301. As noted above, even when the arranged position of fine resin particle attaching device 215 is changed, the layers of the electrostatic fine resin particles and the image visualizing particles formed on intermediate transfer body 301 are mixed together to be in the state shown in FIG. 6*a* because they contain the carrier liquid.

Figure 9:
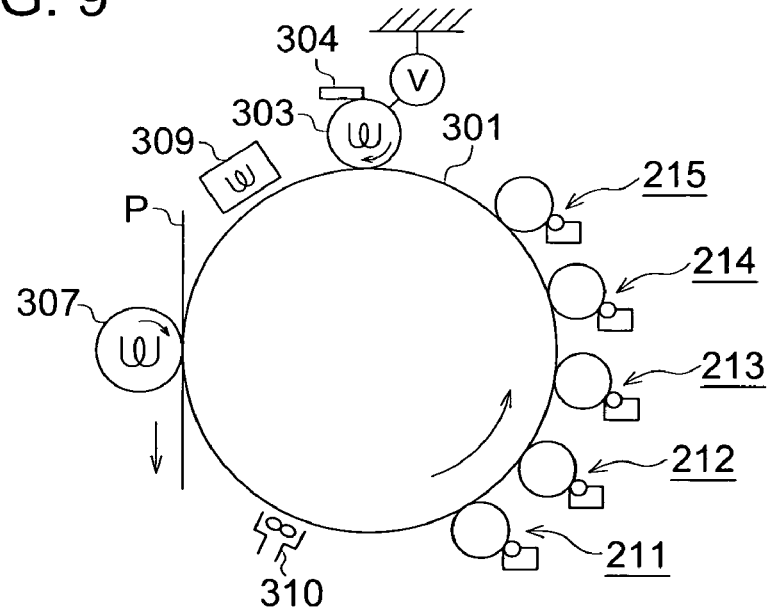
FIG. 9 is a diagram showing another overall constitution of an image forming apparatus in the second embodiment.

Further, intermediate transfer body 301 may be belt-shaped as shown in FIG. 4 or drum-shaped as shown in FIG. 9. When drum-shaped intermediate transfer body 301 is employed, position accuracy is easily enhanced, whereby the driving system may be simply constituted.

Belt-shaped intermediate transfer body 301 may employ the materials and constitution described in the first embodiment.

The layer (the visible image) containing the image visualizing particles and electrostatic fine resin particles layer formed on intermediate transfer body 301 incorporates a large amount of carrier liquid. Due to that, when transfer to a recording medium is carried out without any treatment, an image transfer efficiency is lowered, and images with insufficient fixing strength are formed on the recording medium. In order to minimize the above problems, it is desired that the carrier liquid on intermediate transfer body 301 is reduced.

The above carrier liquid on intermediate transfer body 301 is partially removed with squeezing roller 303 which is a carrier liquid removing member. A voltage of the same polarity as the charging polarity of the image visualizing particles and fine resin particles is applied to squeezing roller 303, and the image visualizing particles and fine resin particles do not move to the squeezing roller 303 side. On the other hand, the carrier liquid is attached to squeezing roller 303, and the amount of the carrier liquid on intermediate transfer body 301 decreases after squeezing roller 303 passes by. The carrier liquid having been moved onto the squeezing roller 303 side is removed with cleaning blade 304.

Prior to the visualized image being transferred to recording medium P by squeezing roller 303, the amount of the carrier liquid on intermediate transfer body 301 is decreased. Due to the decrease in the amount of the carrier liquid, the toner particles in the image are brought into contact with each other and further closely contacted to aggregate.

Under such a state, by employing backup roller 306 and secondary transferring roller 307 which is a heating roller incorporating a heater in its interior, the toner image is thermal melt transferred to recording medium P. At that time, a transfer efficiency is nearly 100%, and fixability after transfer is enhanced, whereby it is possible to form images with sufficient fixing strength.

It is preferable that squeezing roller 303 incorporates a heater in its interior and heats the liquid developer on intermediate transfer body 301. Further, backup roller 305 may also incorporate a heater.

Squeezing roller 303 may employ the materials and constitution which are the same as those described in the first embodiment.

As noted above, prior to the visible image being transferred to recording medium P, the image visualizing particles and fine resin particles are heated, so that those particles are converted into film, whereby the transfer efficiency gets closer to 100%.

In the above description, thermal transfer is employed in the secondary transfer, but the secondary transfer may employ electric field transfer or shearing transfer. When the thermal transfer is employed, secondary transferring roller 307 and/or backup roller 306 incorporate a heater. In such a case, heating temperature is preferably from 80 to 200° C. Secondary transferring roller 307 is preferably an elastic body with an Asker A hardness of from 80 to 200° C. Usable major materials include, but are not limited to, silicone rubber, fluororubber, EPDM, urethane rubber, and nitrile rubber.

After the visible image being transferred onto recording medium P, intermediate transfer body 301 is cooled with cooling member 310. It is possible to employ, as cooling member 310, a cooling fan. By cooling intermediate transfer body 301 with cooling member 310, heat transferred to photoreceptor 201 is minimized, whereby it is possible to enhance durability of photoreceptor 201. Alternatively, it is possible to omit above cooling member 310.

Figure 10:
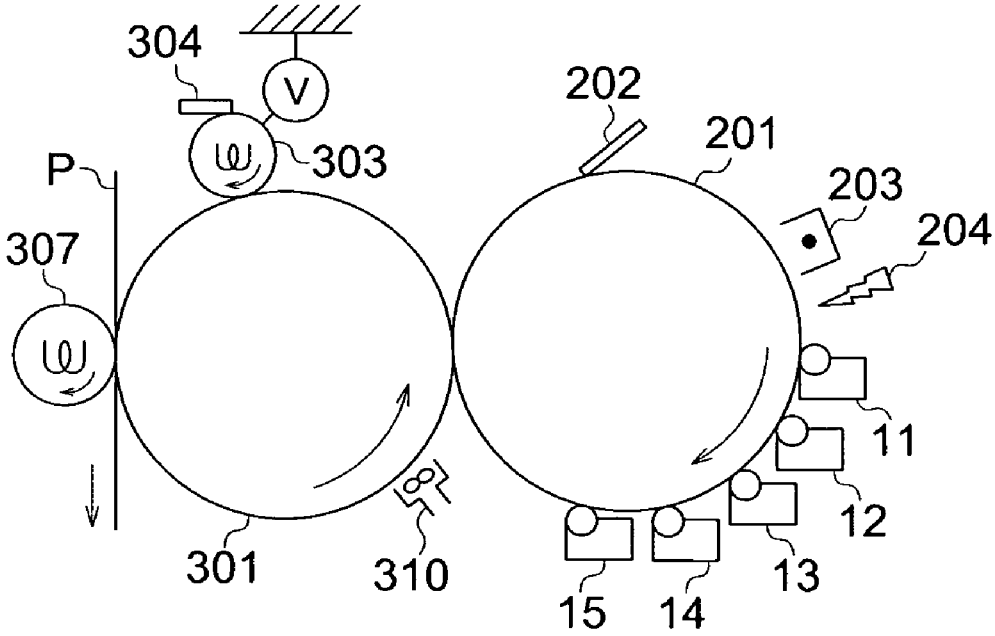
FIG. 10 is a diagram showing another overall constitution of an image forming apparatus in the second embodiment.

In the second embodiment described above, the visualized image of each color and the electrostatic fine resin particle image are superimposed on intermediate transfer body 301, and thereafter, the resulting images are transferred onto recording medium P by secondary transferring roller 307. As another aspect, it is acceptable that as shown in FIG. 10, the visualized image of each color and the electrostatic fine resin particle image are superimposed on a photoreceptor 201, and superimposed images are integrally transferred onto an intermediate transfer body. In this case, the image forming operation is executed as follows. Initially, the surface of photoreceptor 201 is charged with a charging device 203. After exposure of image data by an exposure device 204, development is carried out by a first developing device 11. The toner image developed by the first developing device is again charged thereon with charging device 203, and exposure of the second image information is carried out by exposure device 204, and development is conducted by the second developing device 12. The above operation is repeated, and a color image is formed on photoreceptor 201. Thereafter, charging is carried out with charging device 203, and the color image information is exposed by exposure device 204. Subsequently, development is carried out by a developing device 15 incorporating a liquid developer containing electrostatic fine resin particles. As noted above, the toner image of each color and the electrostatic fine resin particle image are superimposed on photoreceptor 201, and the resulting images are integrally transferred onto intermediate transfer body 301. Thereafter, a part of the carrier liquid on intermediate transfer body 301 is removed with carrier liquid removing member 303, and the color image is transferred onto recording medium P by secondary transferring roller 307.

Further, as still another aspect, a constitution may be acceptable in which, without employing intermediate transfer body 301, an image, which is prepared by superimposing the visualized image of each color formed on photoreceptor 201 and the electrostatic fine resin image, is directly transferred onto recording medium P. In this case, squeeze roller 303 is preferably arranged around photoreceptor 201 to remove a part of the carrier liquid from a visible image on the photoreceptor 201.

(Composition of Liquid Developer)

In the above second embodiment, the liquid developer contains at least a carrier liquid, image visualizing particles, and a dispersing agent.

As the carrier liquid, selected are liquids which are non-volatile having a vapor pressure of less than or equal to 200 Pa, a relatively low dielectric constant of less than or equal to 3, and a high electric insulation property. For example, selected is any of hydrocarbon based ones (such as liquid paraffin), silicone oil, plant and animal oil, and mineral oil.

Examples of image visualizing particles include pigments, dye-colored resins, and pigment-dispersed resins.

It is possible to employ, as pigments, the same fine pigment particles as those in the first embodiment.

Further, in the case of a resin-dispersed body which is colored by dyes or pigments, usable resins constituting a colored resin-dispersed body include, but are not limited to, acrylic resins, styrene resins, styrene-acryl copolymer resins, polyester resins, epoxy resins, and epoxy resins.

Image visualizing particles may be prepared by a method in which resins and pigments are fused and kneaded, and the resulting mixture is pulverized, and dispersed into a carrier liquid, in which a so-called chemical toner is polymerized in an aqueous system, and dispersed into a carrier liquid after being dried, or in which polymerization is carried out in a carrier liquid.

Further, in order to enhance dispersibility of the image visualizing particles, pigment derivatives may be employed. It is possible to employ pigment derivatives having desired functional groups such as a carboxyl group, a sulfonic acid group, a hydroxyl group, an amino group, or an amido group.

The image visualizing particles are dispersed into a carrier liquid. The average particle diameter is preferably from 50 nm to 10 μm, but is more preferably from 100 nm to 5 μm. When it exceeds 10 μm, image quality tends to deteriorate, while developability may be deteriorated when it is less than 50 nm.

The combination ratio of image visualizing particles is preferably from 3 to 30% by mass with respect to the mass of the carrier liquid. When it is less than 3% by mass, desired image density may not be realized, while dispersibility may be deteriorated when it is more than 30% by mass.

As the dispersing agents, employed may be those which are the same as the dispersing agents in the first embodiment.

When pigments are employed as the image visualizing particles, the amount of dispersing agents is preferably from 10 to 200% by mass with respect to the pigments. The necessary amount of dispersing agents varies depending on the diameter of pigment particles. When particles with a smaller diameter are used, the combination ratio should be greater. When it is less than 10% by mass, dispersibility may be deteriorated, while the electric conductivity of the liquid so high as to lower the chargeability when it is more than 200% by mass.

(Composition of Liquid Incorporating Electrostatic Fine Resin Particles)

The liquid, which incorporates the electrostatic fine resin particles, contains at least the electrostatic fine resin particles and liquid. As the liquid, employed may be a carrier liquid which may be employed for the liquid developer. Although the electrostatic fine resin particles can be slightly colored to an extent such that images are not adversely affected, they are preferably transparent and colorless.

It is preferable that the electrostatic fine resin particles are thermoplastic and have a glass transition temperature of from 0 to 60° C. The particle diameter is preferably from 10 to 500 nm. When it more than 500 nm, the fine particles tend to aggregate, and it is difficult to realize effects for the fine particles to squeeze the carrier liquid and self-film-forming ability. It is difficult to prepare particles of less than 10 nm, and mobility of the fine particles by an electric field is limited. Accordingly, the particle diameter is more preferably from 50 to 500 nm. Further, in the second embodiment, the diameter of the fine resin particles should be less than that of image visualizing particles. When the diameter of the fine resin particles is greater than that of the image visualizing particles, the liquid reducing effect is decreased.

It is possible to employ, as electrostatic fine resin particles, commercial ones or non-aqueous based dispersion (NAD), or it is possible to manufacture them.

NAD contains a dispersion phase not soluble in solvent and polymer dispersion stabilizing agents. As one example of the resin dispersion phase, there may be presented radically polymerized acryl based polymers. Polymer dispersion stabilizing agents are polymers with a number average molecular weight of greater than or equal to 1,000, and have a combination active site with the resin dispersion phase, and further have functional groups which are necessary for cross-linkage and adhesion. Preferred polymer dispersing agents include those agents which are prepared by introducing functional groups, such as a hydroxyl group, a carboxyl group, a glycidyl group, an amino group or an amido group, into acrylic resins, polyester resins, alkyd resins, melamine resins or cellulose derivatives. The glass transition temperature of the resin dispersion phase is preferably from 0 to 60° C. When it is less than 0° C., storage stability is deteriorated, and when it is less than 60° C., fixability may be deteriorated. A dispersion phase, such as the NAD dispersion phase, incorporating small diameter particles and many polar groups, exhibits higher stability in a liquid state, compared to common liquid developers, and its Tg can be lowered, whereby fixing at lower temperature is easily achieved. Further, the NAD dispersion phase may incorporate reactive functional groups so that, if desired, particles react with each other, or a reaction in the interior of the particles occurs.

The combination ratio of fine resin particles (solid content) is preferable from 0.5 to 20 times with respect to the combination ratio of the image visualizing particles in the liquid developer. When it is less than 0.5 times, fixability may be deteriorated, and when it exceeds 20 times, viscosity is increased, whereby developability may be deteriorated.

According to the embodiments of the present invention, by removing a part of the carrier liquid in the state in which resin particles are present in the liquid developer forming visible images on an image carrier such as a photoreceptor or an intermediate transfer body, it is possible to decrease the carrier liquid among fine pigments particles or toner particles, whereby the image on the image carrier can be transferred onto a recording medium with fewer carrier liquid contained therein. By doing so, it is possible to form an image with sufficient fixing strength on the recording medium. Further, it is possible to enhance the transfer efficiency when transferring the image on the image carrier onto the recording medium.

EXPERIMENTAL EXAMPLES 1 THROUGH 5

Experimental Examples 1 through 5 of the first embodiment will be described.

1. Preparation of Liquid Developer A

| (Dispersion of Pigment into Carrier Liquid) | |
|---|---|
| Pigment: acid-treated copper phthalocyanine derivative | 12 parts by mass |
| Dispersing agent: basic pigment-dispersing agent, SOLSPERSE 13940 (manufactured by Avicia Ltd.) | 5 parts by mass |
| Carrier liquid: liquid paraffin (with a vapor pressure of approximately 30 Pa and a flash point of 144° C.) | 100 parts by mass |

The mixture of the above components was stirred for over 24 hours together with 100 parts by mass of zirconia beads by a paint conditioner, and then the beads were removed, whereby Pigment-Dispersed Liquid 1 was prepared. The diameter of the fine pigment particles of Pigment-Dispersed Liquid 1 was measured by a size distribution meter (SALD-2200, produced by Shimadzu Corp.), and the volume average particle diameter was determined to be 120 nm.

(Dispersion of Fine Resin Particles into Carrier Liquid)

Initially, Dispersing Agent A for fine resin particles was prepared as follows.

In a four-necked flask fitted with a stirrer, a thermometer, a reaction product removing device, and a nitrogen gas introducing tube, the mixture of 100 parts by mass of liquid paraffin, which is the same as the carrier liquid, and 1 part by mass of AIBN (azoisobutylmetholyl) was heated to 120° C. Subsequently added were 25 parts by mass of monomer state methyl methacrylate, 55 parts by mass of lauryl methacrylate, 19 pars by mass of hydroxyethyl methacrylate and 1 part by mass of acrylic acid, and then the mixture was dripped in 4 hours. The resulting product was subjected to vacuum distillation, whereby Dispersing Agent A containing 40% of a nonvolatile portion was prepared.

Subsequently, by employing the Dispersing Agent A, a Fine-Resin-Particle-Dispersed Liquid 1 which includes a carrier liquid and fine resin particles dispersed therein was prepared as follows.

A mixture was prepared by mixing, as raw materials for fine resin particles, 35 parts by mass of methyl methacrylate, 12 parts by mass of hydroxyethyl methacrylate, 2 parts by mass of glycidyl methacrylate, 1 part by mass of acrylic acid, and 1 part by mass of AIBN. This mixture was dripped in 4 hours into a four-necked flask which contained 30 parts by mass of the Dispersing Agent 1 and 70 parts by mass of liquid paraffin as a carrier liquid and was heated to 100° C. Further, 0.5 parts by mass of AIBN and 8 parts by mass of liquid paraffin were added to the above flask, and the mixture was subjected to vacuum distillation, whereby a white turbid Fine-Resin-Particle Dispersed Agent 1 with 50% solid was obtained. The diameter of the fine resin particles was measured by a particle size distribution meter (SALD-2200, manufactured by Shimadzu Corp.), and the volume average particle diameter was determined to be 100 nm.

(Preparation of Liquid Developer A)

Liquid Developer A was prepared by mixing 100 parts by mass of Pigment-Dispersed Liquid 1 and 50 parts by mass of Fine-Resin-Particle-Dispersed Agent 1.

2. Preparation of Liquid Developer B

| (Dispersion of Pigment into Carrier Liquid) | |
|---|---|
| Pigment: base-treated copper phthalocyanine derivative | 8 parts by mass |
| Dispersing agent: basic pigment-dispersing agent, SOLSPERSE 3000 (manufactured by Avicia Ltd.) | 5 parts by mass |
| Carrier liquid: liquid paraffin (with a vapor pressure of approximately 10 Pa and a flash point of 144° C.) | 100 parts by mass |

The mixture of the above compounds was stirred for 24 hours together with 100 parts by mass of zirconia beads by a paint conditioner, and the beads were removed, whereby Pigment-Dispersed Liquid 2 was prepared. The diameter of the fine pigment particles of Pigment Dispersion 2 was measured by a size distribution meter (SALD-2200, produced by Shimadzu Corp.), and the volume average particle diameter is determined to be 300 nm.

(Dispersion of Fine Resin Particles into Carrier Liquid)

Fine-Resin-Particle-Dispersed Liquid 1, which was used for Liquid Developer A, was employed.

(Preparation of Liquid Developer B)

Liquid Developer B was prepared by mixing 100 parts by mass of Pigment-Dispersed Liquid 2 and 40 parts by mass of Fine-Resin-Particle Dispersed Liquid 1.

3. Preparation of Liquid Developer C

| (Dispersion of Pigment into Carrier Liquid) | |
|---|---|
| Pigment: carbon black (MA-100, produced by Mitsubishi Chemical Co., Ltd.) | 8 parts by mass |
| Dispersing agent: basic pigment-dispersing agent, SOLSPERSE 13940 (manufactured by Avicia Ltd.) | 4 parts by mass |
| Carrier liquid: liquid paraffin (with a vapor pressure of approximately 10 Pa and a flash point of 144° C.) | 100 parts by mass |

The mixture of the above compounds was stirred for 24 hours together with 100 parts by mass of zirconia beads by a paint conditioner, and the beads were removed, whereby Pigment-Dispersed Liquid 3 was prepared. The diameter of the fine pigment particles of Pigment Dispersion 3 was measured by a size distribution meter (SALD-2200, produced by Shimadzu Corp.), and the volume average particle diameter was determined to be 80 nm.

(Dispersion of Fine Resin Particles into Carrier Liquid)

Commercial resin-dispersed liquid (ACRYDIC YL-431, produced by Dainippon Ink and Chemicals, Inc.), which contains 60 parts by mass of liquid paraffin as a carrier liquid and 40 parts by mass of fine acrylic resin particles dispersed therein, was employed as Fine-Resin-Particle-Dispersed Liquid 3. The diameter of the fine resin particles was measured by a size distribution meter (SALD-2200, manufactured by Shimadzu Corp.), and the volume average particle diameter was determined to be 50 nm.

(Preparation of Liquid Developer C)

Liquid Developer C was prepared by mixing 100 parts by mass of Pigment-Dispersed Liquid 3 with 40 parts by mass of Fine-Particle-Dispersed Liquid 3.

4. Preparation of Liquid Developer D

Liquid Developer D was prepared in the same manner as Liquid Developer C, except that the commercial resin-dispersed liquid was replaced with NISSETSU U3611 (produced by Nippon Carbide Industries Co., Ltd.). The diameter of the fine resin particles was measured by a size distribution meter (SALD-2200, manufactured by Shimadzu Corp.), and the volume average particle diameter was determined to be 300 μm.

5. Preparations of Liquid Developer E

Liquid Developer E was prepared in the same manner as Liquid Developer A, except that the amount of dispersing agent S134940 (SOLSPERSE 13940) was changed to 2.5 parts by mass. In this case, the diameter of the fine pigment particles was measured by a size distribution meter (SALD-2200, manufactured by Shimadzu Corp.), and the volume average particle diameter was determined to be 1.5 μm.

6. Preparations of Liquid Developer F

By employing a Henschel mixer, 100 parts by mass of a styrene-acryl copolymer (styrene butyl methacrylate methyl methacrylate=70:25:5, Mn=5,300, and Mw=23,500) and 10 parts by mass of copper phthalocyanine were mixed. After melt-mixing by a biaxial extrusion kneading apparatus, cooling was carried out. Thereafter, rough powdering was carried out followed by kneading to an average particle diameter of 10 μm by a jet kneader, whereby fine pigment resin particles were prepared.

Mixture was made by mixing 20 parts by mass of the above fine pigment resin particles, 3 parts by mass of SOLSPERSE S13940 as a dispersing agent, and 100 parts by mass of liquid paraffin (with a vapor pressure of approximately 5 Pa, and a flash point of 200° C.), and 100 parts by mass of zirconia beads, and the mixture was stirred in a sand mill for 120 hours, whereby Liquid Developer F was prepared. The diameter of the fine pigment resin particles was measured by a size distribution meter (SALD-2200, manufactured by Shimadzu Corp.), and the volume average particle diameter was determined to be 2 μm.

Experimental Example 1

Fixability was evaluated employing the image forming apparatus shown in FIG. 1. Photoreceptor 201 was prepared by forming an organic photoreceptor film (with a film thickness of 35 μm) on an aluminum drum with a diameter of 100 mm. Its peripheral rotational speed was set at 200 mm/s. The liquid developer on developing roller 103 was positively charged by discharge from a charge wire which was applied with a voltage of 5 kV by corotron charging device 105. A scorotron charger was employed as charging device 203, and the surface electric potential of photoreceptor 201 was set to be 600 V. Exposure device 204 was set so that the surface electric potential of photoreceptor 201 would become 100 V when an image area would be exposed by a semiconductor laser, and a voltage of 400 V was applied to developing roller 103.

Developer A was employed as a liquid developer, and a solid pattern (a 100% solid image) was printed as an image pattern. At the time, the developer amount on developing roller 103 was regulated to be 7.5 g/m$^2$ (solid content being 20%). An voltage of −800V was applied to primary transferring roller 302.

Employed intermediate transfer body 301 had a multi-layered constitution including a 100 μm polyimide resin layer and a 500 μm thick silicon rubber layer. The amount of the developer on 301 immediately after primary transferring roller 302 was 5 g/m$^2$ (solid content being 30%). Squeezing roller 303 was a 30 mm diameter silicone roller with an Asker A hardness of 40° C. Herein, when resin components in the liquid developer were melted by an installed heater in squeezing roller 303, squeezing efficiency is enhanced. Heating was carried out so that the surface temperature of squeezing roller 303 is 120° C. Further, a voltage of 1,000 V was applied to squeezing roller 303. A carrier liquid removing blade 304 was a metal blade, and the carrier liquid recovered by squeezing roller 303 was removed with carrier liquid removing blade 304. The amount of the developer after passing squeezing roller 303 was 1.8 g/m$^2$ (solid content being 83%).

Halogen heater 309 heats the surface of intermediate transfer body 301 and melts resin components in the developer on intermediate transfer body 301. Secondary transferring roller 307 is heated to 140° C. and is made of a silicone rubber roller at an Asker hardness of 40° C. By employing secondary transferring roller 307, the developer was transferred onto and fixed on OK TOP COAT paper produced by Oji Paper Co., Ltd. as recording medium P.

Experimental Examples 2 Through 5

Experimental Examples 2 through 5 were carried out in the same manner as Experimental Example 1, except that Developer A in Experimental Example 1 was replaced with each of Developers B through E, and evaluation was carried out.

Comparative Example 1

Comparative Example 1 was carried out in the same manner as Experimental Example 1, except that Developer A was replaced with Developer F, and evaluation was carried out.

The liquid amount of the developer after passing squeezing roller 303 was 3 g/m$^2$ (at 67% solid).

(Evaluation)

Transfer efficiency: The residual toner on the intermediate transfer body after the secondary transfer onto a recording medium was visually observed, and evaluation was carried out based on the following criteria:

A: no residual toner was observed

B: the residual toner was slightly observed, resulting in no problem

C: the residual toner was clearly observed, resulting in problems

Fixability evaluation: Fixed images were subjected to a tape peeling test. SCOTCH MENDING TAPE (produced by Sumitomo 3M Co., Ltd.) was employed. Reflection densities before and after the peeling were measured, and evaluation was carried out based on the following criteria:

A: density ratio between before and after was 90% or more

B: the above density ratio was 80 or more and less than 90%

C: the above density ratio was less than 80%

A and B were acceptable (a densitometer, produced by X-Rite Co., was employed for measurements).

Table 1 shows the evaluation results.

TABLE 1

| | Liquid Developer | Fine Pigment Particles Average Particle Diameter (nm) | Fine Resin Particles Average Particle Diameter (nm) | Fine Pigment Resin Particles Average Particle Diameter (nm) | Transfer Efficiency | Fixability Evaluation Result |
|---|---|---|---|---|---|---|
| **1 | A | 120 | 100 | — | A | A |
| **2 | B | 300 | 100 | — | A | A |
| **3 | C | 80 | 50 | — | A | A |
| **4 | D | 80 | 300 | — | A | A |
| **5 | E | 1500 | 100 | — | A | B |
| Comp. 1 | F | — | — | 2000 | A | C |

**Experimental Example,
Comp.: Comparative Example

Based on the results in Table 1, it is noted that fixing strength of Experimental Examples 1 through 5 was improved compared to Comparative Example 1. In Experimental Example 5, fixing strength was slightly lowered. The reason is thought to be as follows. The diameter of fine pigment particles in Experimental Example 5 was rather large, as high as 1,500 nm, whereby the carrier liquid removing effect was reduced.

EXPERIMENTAL EXAMPLES 6 AND 7

Experimental Examples 6 and 7 in the second embodiment will now be described.

1. Preparation of Liquid Developer G

| | |
|---|---|
| Acid-treated copper phthalocyanine derivative | 12 parts by mass |
| Basic pigment-dispersing agent, SOLSPERSE 13940 (manufactured by Avicia Ltd.) | 5 parts by mass |
| Liquid paraffin (with a vapor pressure of less than or equal to 200 Pa and a flash point of 144° C.) | 100 parts by mass |

The mixture of the above compounds was stirred for 24 hours together with 100 parts by mass of zirconia beads by a paint conditioner, and the beads were removed, whereby Blue Pigment-Dispersed Liquid 1C was prepared. The diameter of Blue Pigment Dispersion 1C was measured by a size distribution meter (SALD-2200, produced by Shimadzu Corp.), and was determined to be 90 nm.

In the same way as above, prepared were Magenta-Pigment-Dispersed Liquid 1M (with a particle diameter of 100 nm) in which quinacridone was dispersed, Yellow-Pigment-Dispersed Liquid 1Y (with a particle diameter of 120 nm) in which pigment yellow was dispersed, and Black-Pigment-Dispersed Liquid 1Bk (with a particle diameter of 100 nm) in which carbon black was dispersed.

(Preparation of Liquid Developer H)

By employing a Henschel mixer, 100 parts by mass of a styrene-acryl copolymer (styrene:butyl methacrylate:methyl methacrylate=70:25:5, Mn=5,300, and Mw=23,500), and 10 parts by mass of copper phthalocyanine were sufficiently mixed. After melt-mixing by a biaxial extrusion kneading apparatus, cooling was conducted. Thereafter, rough powdering was carried out, followed by kneading to an average particle diameter of 10 μm by a jet kneader.

Adding to 20 parts by mass of the above fine pigment resin particles, 3 parts by mass of SOLSPERSE S13940 as a dispersing agent, 100 parts by mass of liquid paraffin (with a vapor pressure of 200 Pa and a flash point of 200° C.), and 100 parts by mass of zirconia beads were mixed together, and the mixture was stirred for 120 hours by a sand mill, whereby Blue-Pigment-Dispersed Liquid 2C was prepared. The average particle diameter of the developer was 2 μm.

In the same manner as above, as a sample, prepared were Magenta-Pigment-Dispersed Liquid 2M (with a particle diameter of 2 μm) in which quinacridone dispersion resin was dispersed, Yellow-Pigment-Dispersed Liquid 2Y in which pigment yellow dispersion resin was dispersed, and Black-Pigment-Dispersed Liquid 2Bk in which carbon black dispersion resin was dispersed.

(Preparation of Fine-Resin-Particle-Dispersed Liquid 4 Incorporating Electrostatic Fine Resin Particles)

In a four-necked flask fitted with a stirrer, a thermometer, a reaction product removing device, and a nitrogen gas introducing tube, the mixture of 100 parts by mass of liquid paraffin and 1 part by mass of AIBN was heated to 120° C. Subsequently added were 25 parts by mass of methyl methacrylate, 55 parts by mass of lauryl methacrylate, 19 parts by mass of hydroxyethyl methacrylate and 1 part by mass of acrylic acid, and the mixture was dripped in 4 hours. The resulting product was subjected to vacuum distillation, whereby Resin Solution A containing 40% of a nonvolatile portion was prepared.

In a four-necked flask, the mixture of 30 parts by mass of Resin Solution A and 70 parts by mass of liquid paraffin was heated to 100° C. Subsequently, into to the above mixture, dripped in 4 hours was the mixture containing 35 parts by mass of methyl methacrylate, 12 parts by mass of hydroxyethyl methacrylate, 2 parts by mass of glycidyl methacrylate, 1 part by mass of acrylic acid, and 1 part by mass of AIBN. Further, added were 0.5 parts by mass of AIBN and 8 parts by mass of liquid paraffin, and the mixture was subjected to vacuum distillation, whereby white turbid Fine-Resin-Particle-Dispersed Liquid 4 with 50% solid was prepared. The diameter of the prepared particles was determined to be 50 nm.

(Preparation of Fine Resin Particle Dispersion 5 Incorporating Electrostatic Fine Resin Particles)

50 parts by mass of NISSETSU U3611 (produced by Nippon Carbide Industries Co., Ltd), a commercial resin-dispersed liquid and 50 parts by mass of nonvolatile liquid paraffin were mixed. The diameter of fine resin particles was measured by a particle size distribution meter (SALD-2200, produced by Shimadzu Corp.), and the volume average particle diameter was determined to be 300 nm.

Experimental Example 6

The wet system image forming apparatus shown in FIGS. 4 and 5 was employed. Image carrier 201 was prepared by forming an organic photoreceptor film (with a film thickness of 35 μm) on a 100 mm diameter aluminum drum, and the peripheral rotational speed was set at 200 mm/s. A scorotron charger was employed as charging device 201, and the surface electric potential of image carrier 201 was set to be 600 V. The developing roller 103 is applied with a voltage of 400V. Exposure device 204 was a semiconductor laser and set so that the surface electric potential of image carrier 1 would become 100 V when an image portion would be exposed, and a voltage or 400 V was applied to developing roller 103. Further, toner on developing roller 103 was positively charged by supplying a voltage of 5 kV to corotron charging device 15 from the power source to release positive ions.

Pigment Dispersions 1C, 1M, 1Y, and 1Bk were used as liquid developers. A half pattern was printed as an image pattern, and a voltage of 800 V was applied to primary transferring rollers 216-219.

Employed intermediate transfer body 301 had a multilayered constitution including a 100 μm polyimide resin layer and a 500 μm thick silicone rubber thereon. The total amount of the developer on 301 just after primary transferring roller 219 was approximately 6 g/m$^2$.

As a liquid incorporating electrostatic fine resin particles, employed was Fine-Resin-Particle-Dispersed Liquid 4. A voltage of −1,200V was applied to primary transferring roller 220, and Fine-Resin-Particle-Dispersed Liquid 4 was moved onto intermediate transfer body 301. The total amount of the liquid attached onto intermediate transfer body 301 just after transfer was 12 g/m$^2$.

Squeezing roller 303 was a 30 mm diameter silicone rubber roller with an Asker hardness of 40° C. Herein, a heater was arranged in squeezing roller 303 and squeezing efficiency was enhanced by melting the developer resin components. The heating temperature was 180° C. Further, 1,000 V voltage was applied to squeezing roller 303. A cleaning blade 304 was a metal blade, and the cleaning blade 304 removed the carrier liquid recovered by squeezing roller 303.

Halogen heater 309 was installed so that the resin components of the liquid developer were melted prior to the secondary transfer by heating the surface of intermediate transfer body 301. The surface temperature of secondary transferring roller 307 was maintained at 140° C., and a silicone rubber roller with an Asker A hardness of 40° C. was employed. OK TOP COAT sheet produced by Oji Paper Co., Ltd., which was served as a recording medium, was passed through between secondary transferring roller 307 and intermediate transfer body 301, and the image on intermediate transfer body 301 was transferred thereon and simultaneously fixed.

Experimental Example 7

Experimental Example 7 was carried out under the same conditions as Experimental Example 6, except that Fine-Resin-Particle-Dispersed Liquid 5 was employed instead of Fine-Resin-Particle-Dispersed Liquid 4 as the liquid incorporating electrostatic fine resin particles in Experimental Example 6.

Comparative Example 2

In Comparative Example 2, no coating of the electrostatic fine resin particles was carried out by the fine resin particle attaching device in Experimental Example 6. The other conditions were the same as those of Experimental Example 6.

(Evaluation)

Transfer efficiency: The toner on the intermediate transfer body after the secondary transfer onto recording medium P was visually observed, and evaluation was carried out based on the following criteria:

A: no toner was observed

B: a small amount of toner was observed, resulting however in no problem

C: a significant amount of toner was clearly observed, resulting in problems

Fixability evaluation: Fixed images were subjected to a tape peeling test. SCOTCH MENDING TAPE (produced by Sumitomo 3M Co., Ltd.) was employed. Reflection densities before and after the peeling were measured, and evaluation was carried out based on the following criteria:

A: density ratio between before and after was 90% or more

B: the above density ratio was 80 or more and less than 90%

C: the above density ratio was less than 80%

A and B were acceptable (the densitometer, produced by X-Rite Co., was employed for measurements).

Table 1 shows the evaluation results.

TABLE 1

| | Liquid Developer | Fine Resin Particle Dispersion | Transfer Efficiency | Fixability Evaluation Result |
|---|---|---|---|---|
| Experimental Example 6 | A (90-120 nm) | 1 (50 nm) | A | A |
| Experimental Example 7 | B (2000 nm) | 2 (300 nm) | A | A |
| Comparative Example 2 | A (90-120 nm) | — | A | C |

Based on the results in Table 1, it is noted that in Experimental Examples 6 and 7, by decreasing a carrier liquid with the carrier liquid removing device after adhesion of electrostatic fine resin particles of an average diameter smaller than that of image visualizing particles, fixing strength was enhanced compared to Comparative Example 2 where no electrostatic fine resin particles were employed.

What is claimed is:

1. An image forming apparatus, comprising:

a developing device which is adapted to contain a liquid developer including a nonvolatile carrier liquid, fine pigment particles dispersed in the carrier liquid and thermoplastic fine resin particles dispersed in the carrier liquid, and to develop an electrostatic latent image into a visible image with the liquid developer, the pigment particles and the fine resin particles being charged to a same charging polarity, wherein the fine pigment particles are different from the thermoplastic fine resin particles and not one of the fine pigment particles forms a part of a particle with any one of the thermoplastic fine resin particles;

a squeezing mechanism which is adapted to remove a part of the carrier liquid included in the visible image formed by the developing device; and a transferring mechanism which is adapted to transfer the visible image, from which the part of the carrier liquid has been removed by the squeezing mechanism, onto a recording medium, wherein the fine resin particles in the carrier liquid are positioned between the fine pigment particles in the carrier liquid so that the amount of carrier liquid among the fine resin particles and the fine pigment particles of the visible image present after the visible image is squeezed by the squeezing mechanism is reduced when compared to the squeezing of the visible image when fine resin particles are not used.

2. The image forming apparatus of claim 1, wherein a volume average diameter of the fine resin particles in the carrier liquid is not less than 10 nm and not more than 500 nm.

3. The image forming apparatus of claim 1, wherein a volume average diameter of the pigment particles in the carrier liquid is not less than 30 nm and not more than 500 nm.

4. The image forming apparatus of claim 1, wherein the squeezing mechanism includes: a sliding member which is applied with a voltage of the same polarity as the charging polarity of the pigment particles.

5. The image forming apparatus of claim 1, wherein the transferring mechanism includes: a heating roller which has a heater.

6. The image forming apparatus of claim 1, further comprising: a heating mechanism which is adapted to heat the visible image, from which the part of the carrier liquid has been removed by the squeezing mechanism, before the visible image is transferred onto the recording medium.

7. The image forming apparatus of claim 1, wherein the fine resin particles in the carrier liquid and the fine pigment particles aggregate with one another.

8. A method for forming an image, comprising:

developing an electrostatic latent image into a visible image with a liquid developer which includes a nonvolatile carrier liquid, fine pigment particles dispersed in the carrier liquid and thermoplastic fine resin particles dispersed in the carrier liquid, the pigment particles and the fine resin particles being charged to a same charging polarity, wherein the fine pigment particles are different from the thermoplastic fine resin particles and not one of the fine pigment particles forms a part of a particle with any one of the thermoplastic fine resin particles;

removing a part of the carrier liquid included in the visible image; and transferring the visible image, from which the part of the carrier liquid has been removed, onto a recording medium, wherein the fine resin particles in the carrier liquid are positioned between the fine pigment particles in the carrier liquid so that the amount of carrier liquid among the fine resin particles and the fine pigment particles of the visible image present after the removing the part of the carrier liquid is reduced when compared to the removing the part of the carrier liquid when fine resin particles are not used in the method.

9. The method of claim 8, wherein the fine resin particles in the carrier liquid and the fine pigment particles aggregate with one another.

10. An image forming apparatus, comprising:

a developing device which is adapted to contain a liquid developer including a nonvolatile carrier liquid, toning particles dispersed in the carrier liquid, and to develop an electric latent image into a visible image with the liquid developer;

a resin particle supplying mechanism which is adapted to contain an auxiliary liquid including fine resin particles with a diameter smaller than a diameter of the toning particles and to apply the auxiliary liquid to the visible image to make the fine resin particles exist therein, the fine resin particles not visually affecting the visible image;

a squeezing mechanism which is adapted to remove a part of the carrier liquid included in the visible image; and a transferring mechanism which is adapted to transfer the visible image, from which the part of the carrier liquid has been removed by the squeezing mechanism, onto a recording medium, wherein the fine resin particles existing in the visible image are present in carrier liquid containing the toning particles and wherein the fine resin particles in the carrier liquid containing the toning particles are positioned between the toning particles in the carrier liquid so that the amount of carrier liquid among the fine resin particles and the toning particles of the visible image present after the visible image is squeezed by the squeezing mechanism is reduced when compared to the squeezing of the visible image when fine resin particles are not used.

11. The image forming apparatus of claim 10, wherein the resin particle supplying mechanism attaches the fine resin particles to the visible image only in a region in which the toning particles exist.

12. The image forming apparatus of claim 10, wherein a volume average diameter of the fine resin particles is not less than 10 nm and not more than 500 nm.

13. The image forming apparatus of claim 10, wherein the toning particles include a mixture of resin and a coloring agent.

14. The image forming apparatus of claim 10, wherein the toning particles are pigment particles.

15. The image forming apparatus of claim 10, wherein the toning particles and the fine resin particles are charged to a same charging polarity.

16. The image forming apparatus of claim 10, wherein the squeezing mechanism includes: a sliding member which is applied with a voltage of the same polarity as a charging polarity of the toning particles.

17. The image forming apparatus of claim 10, wherein the transferring mechanism includes: a heating roller which has a heater.

18. The image forming apparatus of claim 10, further comprising: a heating mechanism which is adapted to heat the visible image, from which the part of the carrier liquid has been removed by the squeezing mechanism, before the visible image is transferred onto the recording medium.

19. The image forming apparatus of claim 10, wherein the resin particle supplying mechanism supplies the fine resin particles to the visible image from thereabove after the visible image is formed by the developing device.

20. The image forming apparatus of claim 10, wherein the resin particle supplying mechanism attaches the fine resin particles to an image carrier, on which the visible image is to be formed by the developing device, before the visible image is formed, so that the fine resin particles are to exist in the visible image.

21. A method for forming an image, comprising:

developing an electrostatic latent image into a visible image with a liquid developer which includes a nonvolatile carrier liquid and toning particles dispersed in the carrier liquid;

applying an auxiliary liquid, which includes fine resin particles with a diameter smaller than a diameter of the toning particles, to the visible image to make the fine resin particles exist therein, the fine resin particles not visually affecting the visible image;

removing a part of the carrier liquid included in the visible image; and transferring the visible image, from which the part of the carrier liquid has been removed, onto a recording medium, wherein during the applying the fine resin particles existing in the visible image are present in carrier liquid containing the toning particles and wherein the fine resin particles in the carrier liquid containing the toning particles are positioned between the toning particles in the carrier liquid so that the amount of carrier liquid among the fine resin particles and the toning particles of the visible image present after the removing the part of the carrier liquid is reduced when compared to the removing the part of the carrier liquid when fine resin particles are not used in the method.

* * * * *

UNITED STATES PATENT AND TRADEMARK OFFICE

CERTIFICATE OF CORRECTION

PATENT NO. : 8,185,020 B2
APPLICATION NO. : 12/220386
DATED : May 22, 2012
INVENTOR(S) : Yoshie It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 536 days.

Signed and Sealed this
Twenty-sixth Day of June, 2012

David J. Kappos

David J. Kappos
*Director of the United States Patent and Trademark Office*